United States Patent [19]

Miller et al.

[11] 4,144,529

[45] Mar. 13, 1979

[54] REMOTELY RESPONSIVE MOTION DETECTOR

[75] Inventors: George B. Miller, 11621 Kensington, Rossmore, Calif. 90720; Jack K. Denapole, Costa Mesa, Calif.

[73] Assignee: George B. Miller, Rossmore, Calif.

[21] Appl. No.: 798,791

[22] Filed: May 20, 1977

[51] Int. Cl.[2] ..... G08B 13/26

[52] U.S. Cl. ..... 340/562; 331/65; 340/561

[58] Field of Search ..... 340/258 C, 258 B, 562, 340/561; 331/65

[56] References Cited

U.S. PATENT DOCUMENTS

| | | | |
|---|---|---|---|
| 2,992,420 | 7/1961 | Riker | 340/562 |
| 3,549,905 | 12/1970 | Johnson | 340/562 |
| 3,706,982 | 12/1972 | Gehman | 340/552 |
| 3,778,807 | 12/1973 | Ralston | 340/552 |
| 3,836,828 | 9/1974 | Siegel | 317/146 |
| 3,863,240 | 1/1975 | Galvin | 340/552 |
| 3,947,734 | 3/1976 | Fyler | 317/146 |
| 4,001,613 | 1/1977 | Hills et al. | 307/308 |

*Primary Examiner*—Glen R. Swann, III

*Attorney, Agent, or Firm*—I. Michael Bak-Boychuk

[57] ABSTRACT

A motion detector comprising a self-excited oscillator operating in the megacycle range which is maintained at a substantially fixed frequency by way of a constant current source. By virtue of the constant current input changes in inductance and capacitance associated with the motion of the intruder are registered as changes in oscillatory amplitude rather than frequency change. This change in amplitude is passed through a low band pass filter, i.e. a filter operating in the range of frequencies normally associated with the motion of a human, and the changes in this filtered signal are then passed through a coupling capacitor to a comparator. In this manner, the DC level, which often drifts in a linear circuit is taken out. The output of the comparator is then applied to a coded transmitter which on the occurrence of an intrusion will set off an alarm at a remotely held receiver.

5 Claims, 4 Drawing Figures

REMOTELY RESPONSIVE MOTION DETECTOR

BACKGROUND OF THE INVENTION

1. Field of the Invention

The present invention relates to detection devices, and more particularly to a remote motion detector for detecting the presence of an intruder within a secured area.

2. Description of the Prior Art

Heretofore most security detection devices have utilized signal reflections, such as radar, in order to determine the presence of intruders in a monitored area. In view of the cost and complexity of a typical radar system, various techniques have been developed in which linear devices like oscillators formed the detector base. Thus frequently but with some regularity certain intrusion detectors did utilize the inductive and capacitive effect of the entering body to provide detection. Typically, however, these last devices discriminate on the basis of frequency changes and the accuracy of the oscillator circuit is the dominant aspect. In order to improve this accuracy, or to reduce the unwanted registration of false alarms, various referencing techniques have been implemented wherein, for example, more than one oscillator would be driven, the detection being made on the basis of the differential taken therebetween. Alternatively a reference oscillator would be used in conjunction with the sensing oscillator to provide a base. In each instance the circuitry is necessarily doubled, increasing the cost and complexity of the system.

In addition, most of the prior art devices using either radar transmission or the capacitive and inductive effect, because of their frequency dependence, require highly accurate frequency control with the attendant sensitivity to component selection and the necessary isolation from external noise and internal drift.

Typically, any intrusion into a secured area entails the movement of a part or the whole of the body of the intruder with the attendant capacitive and inductive characteristics which are distinct from the ambient characteristics of the area monitored. These changes occur at cycle rates dictated by the scaling laws and therefore are quite limited in bandpass. In contrast, background noise is characteristically spread over a wide spectrum with the changes in the ambient conditions occurring at a very low rate and the electromagnetic noise appearing at rates substantially higher than those associated with body motion. Component drift and noise is similarly spread out. Thus, the component selection, temperature compensation and various other controls have to be effected in order to utilize systems as thus frequency dependent detection practiced in the prior art. Furthermore, the generation of a very high frequency imposes a very rigorous requirement as to the shape and consistency of the inductive component in the oscillator, once more resulting in frequency inaccuracies which demand constant attention.

SUMMARY OF THE INVENTION

Accordingly, it is the general purpose and object of the present invention to utilize an oscillator in the detection of an intruder, the oscillator being driven by a constant current source to maintain the frequency substantially constant and to register changes by way of amplitude.

Other objects of the invention are to provide an oscillator for detecting by amplitude changes in a closed area where the frequency of the oscillator is in the megacycle domain while the detection end is selective to pass only those frequencies associated with the motion of the human body.

Yet further objects of the invention are to provide an oscillator for detecting changes in the ambient inductance and capactance, wherein the detection is not primarily dependent on the oscillator frequency.

Yet additional objects of the invention are to utilize a linear circuit in detecting the impedance changes of an ambient environment wherein only changes of certain frequency are registered.

Yet additional objects of the invention are to provide an intrusion detector which, through a radio link, provides an alarm.

Briefly these and other objects are accomplished within the present invention by combining an oscillator with a constant current source, the oscillator being set to oscillate at a frequency approximating four hundred megacycles, with the result that small changes in the inductance and capacatance around the oscillator will effect the resonance thereof. In order to decouple this oscillator discrimination from possible inaccuracies in its base frequency, it is intended to utilize a constant current device which maintains the current levels to the oscillating circuit constant with the result that amplitude changes are registered when changes proximate the oscillator occur. These amplitude changes are then filtered by a low bandpass filter and through a coupling device the changes in these changes are applied to a comparator circuit in order to turn on a tone coded transmitter. Once the tone coded transmitter is thus turned on an audio beeper and a light provide an indication of intrusion at a receiver.

More specifically, the oscillator itself is conformed as a transistor oscillator including an LC tank circuit in series with a single turn of wire deposited on a printed circuit board which, in the manner of an auto-transformer, is center taped to couple through a capacitor into the transistor base. The tank circuit is tied to a sensing antenna through which the inductive and capacitive changes in a room are sensed. This tank circuit is tied to a constant current device, such as a power supply connected across a constant current diode, and will therefore maintain a relatively stable frequency regardless of the changes surrounding the oscillator. It is only the amplitude of the frequency swing that changes with changes in the room and it is by way of these amplitudes that an intruder is detected.

The collector end of the oscillator transistor is tied to the plus terminal of an operational amplifier forming an active bandpass filter for passing amplitude changes in the domain of body motion. The output of this operational amplifier is then coupled through a capacitor to the input of yet another amplifier, this last amplifier being conformed as a level comparator in both directions. More specifically, the output of the coupling capacitor is tied to a voltage divider having a further capacitor across one half thereof and the division point will therefore shift according to the rate changes in the oscillatory amplitude. It is this comparator circuit that drives a switching transistor in order to turn on a twenty-seven megacycle transmitter. Once turned on, the transmitter will then excite a receiver provided both with an audio beeper and a light. It is intended to drive the oscillator at extremely high frequencies, i.e. in the four hundred megacycle range, while the bandpass filter is set to pass the normally low one to ten cycle per second bandpass associated with motions of a human. To further decouple this signal change from the normally very low or the relatively high noise components in the area adjacent the oscillator, the output of the bandpass filter is further differentiated and thus the DC level or the equivalent steady state level of the oscillator is of no significance in providing a detection signal. Thus, the component accuracy, thermal stability, and various other considerations in the oscillator are conveniently taken out and furthermore by virtue of the wide frequency separation the peak in the background noise is similarly attenuated.

DESCRIPTION OF THE PREFERRED EMBODIMENT

While the following description sets out a detector coupled through a radio link to an alarm device, both the function and the arrangement are exemplary only. It is to be noted that uses other than intrusion detection may be achieved by the circuit set out and no intent to limit the scope of the invention by the choice of the example is expressed.

Figure 1:
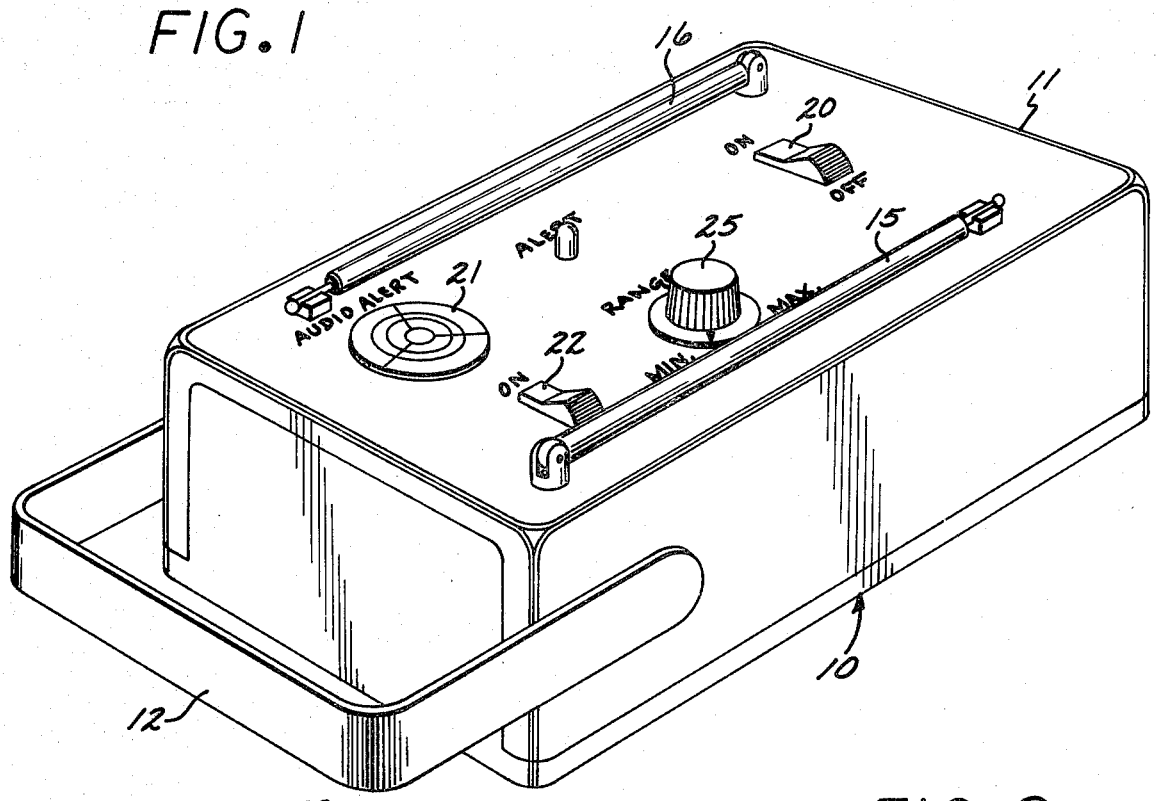
FIG. 1 is a perspective illustration of an intrusion detector constructed according to the present invention.

As shown in FIG. 1, the detector generally designated by the numeral 10, comprises an enclosure 11 provided with a handle 12, the enclosure 11 supporting a collapsible sensing antenna 15 and a transmitting antenna 16. Provided further in the face of enclosure 11 is a master-on-off switch 20 through which the device is turned on. In addition to switch 20, enclosure 11 further includes a local audio or beep generator 21 with an associated disabling switch 22. The gain or sensitivity of the detector itself is adjusted by way of a range potentiometer 25 and it is through this potentiometer that the response sensitivity of the detector is set.

Figure 2:
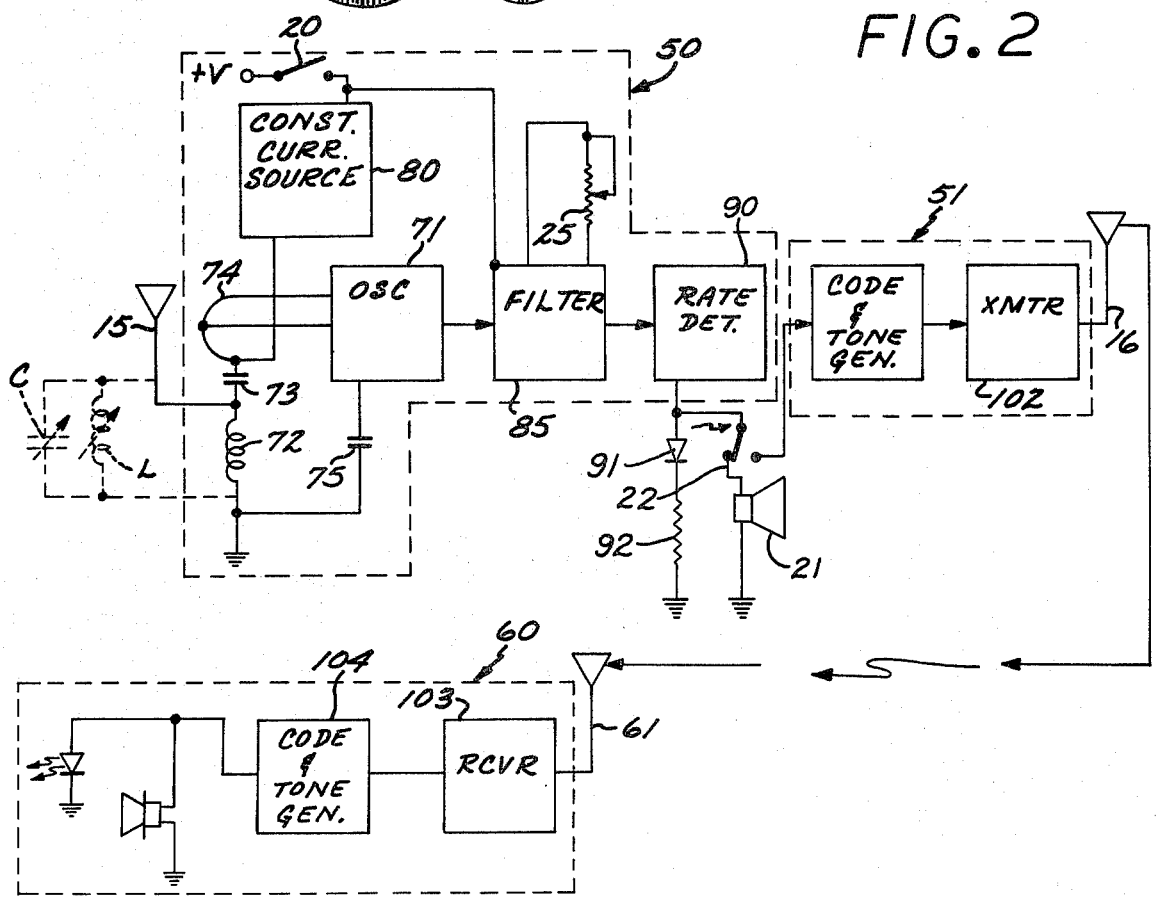
FIG. 2 is a block diagram illustrating the functions associated with the detector shown in FIG. 1.

As shown in FIG. 2 the detector 10 includes a sensing stage 50 and a transmitting stage 51 which, in turn, communicates by radio link to a receiving stage 60 adapted to provide both a tone and a light alarm. In the normal configuration it is intended to utilize commercially available transmitters and receivers for the transmitting stage 51 and the receiving stage 60, and the communication devices operating in the Citizens Band frequency are suitable for this purpose.

The sensor 50 itself includes an oscillator stage 71 connected to a tank circuit comprising an inductor 72 in series with a capacitor 73, the other end of capacitor 73 connecting to yet another single turn inductor 74. This last single-turn inductor 74 is center-tapped in a manner of an autotransformer and therefore provides both the inverting and the plus inputs to the oscillator. Oscillator 71 is furthermore connected to ground by yet another capacitor 75 providing the RF filtering features herein. The juncture between capacitor 73 and inductor 72 is, in turn, connected to the foregoing antenna 15 for sensing the ambient capacitive and inductive changes, shown by way of a phantom capacitor C and a phantom inductor L, which occur upon the entry of an intruder. The other end of capacitor 73, ie. the juncture between capacitor 73 and a single turn inductor 74 is tied to a constant current source 80 receiving a power input shown as a signal +V across the foregoing on-off switch 20. The output end of switch 20, furthermore, is connected to power an active filter stage 85 which also receives as its input the output of the oscillator 71. Filter stage 85, by way of the aforementioned potentiometer 25, is adjustable in gain and will therefore amplify at a selected gain level the signals developed by the oscillator.

The output of the filter stage 85 is, in turn, applied to a rate detector stage 90 which detects any amplitude change rates above a predetermined level. Thus, the oscillator 71, by way of the changes in frequency achieved through changes in impedence C and L, attempts to change its cycle rate and because of the constant current source 80 will change in amplitude. This change in amplitude, if it occurs within the bandpass passed by filter 85, will then trigger the rate detector 90. Once the rate detector 90 is triggered a transmitter stage 51 comprising a code and tone generator 101 and a transmitter 102, is set off. It is this radio signal from the transmitter 51 that sets off the receiver 60, receiver 60 again comprising a conventional receiver stage 103 and a code and tone detector 104. For the purposes herein, the transmitter is included within the detector enclosure 11 and the sending antenna 16 is utilized to transmit the radio signal. Similarly the receiver stage 60 is provided with a necessary antenna 61 driving the receiver stage 103.

The foregoing generally sets out the signal path through the various stages in the circuit. While this signal path comprises the most dominant manner of operation, it is to be noted that various other functions are included herein. More specifically, tied to the output of the rate detector 90 is a light-emitting diode 91 in series with a resistor 92 to ground. Connected in parallel across the diode 91 to ground is a series combination of the above-mentioned switch 22 and the local audio alert or beeper 21. Switch 22 in its other position in turn provides the switch-on signal to the transmitter stage 51 if and when the rate detector 90 senses a particular exceedance.

Figure 3:
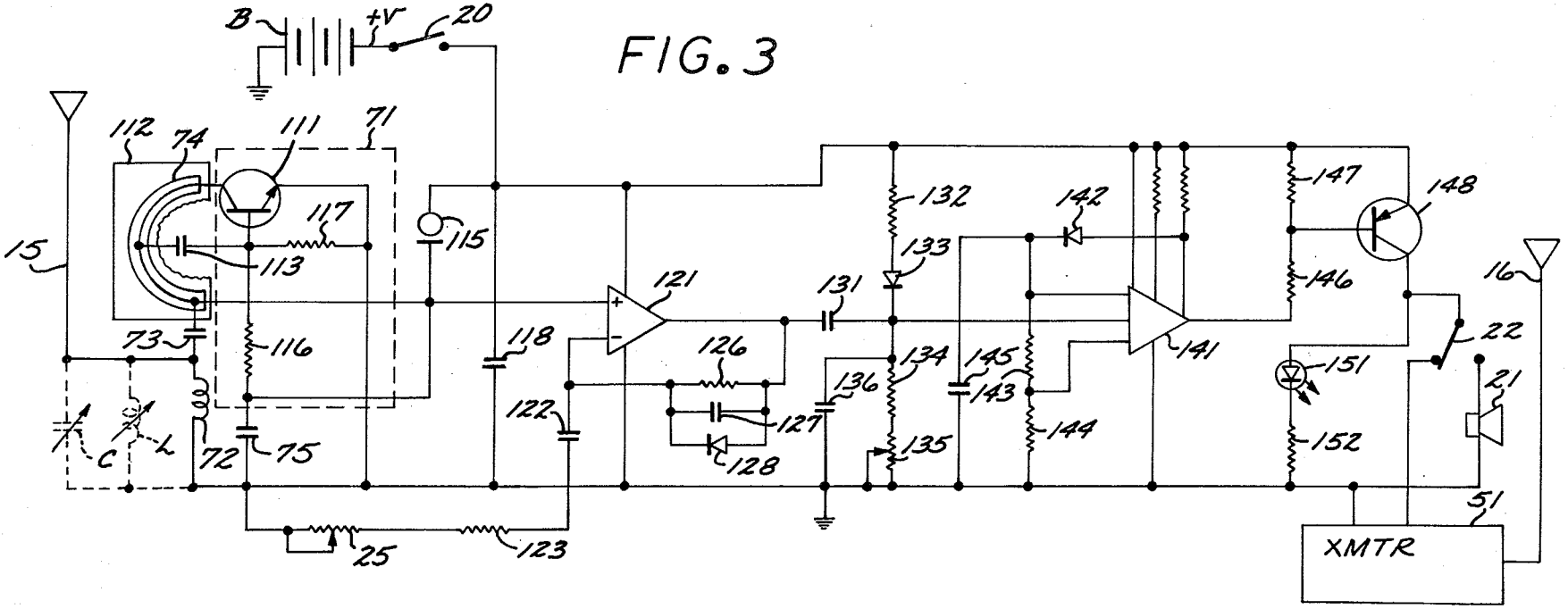
FIG. 3 is a circuit diagram illustrating the sensing and transmitting segment of the detector set out herein.

As shown in FIG. 3, oscillator 71 comprises an NPN transistor 111 tied by its collector to the other end of the single turn inductor 74. For the purposes herein inductor 74 may be deposited as a circuit segment on a printed circuit board 112 and will therefore maintain a stable configuration having very little response to any shock impacts or other environmental inputs. Tied between the center of the single turn inductor 74 and the base of transistor 111 is a capacitor 113 providing the necessary phased input for maintaining the oscillations. The base of transistor 111, furthermore, is tied to the output of the constant current source shown herein by way of a single constant current diode 115, diode 115 connecting across a resistor 116, once more to the base of transistor 111. Yet another resistor 117 providing the necessary bias for the transistor is connected across the base emitter connection. In addition to the above elements, the constant current source also includes a battery B providing the +V signal set out above across switch 20 both to the anode of diode 115 and to the other circuit components described hereinbelow. Diode 115, furthermore, is connected in shunt with a filter capacitor 118 to ground. Capacitor 118 provides the necessary roll-off for the various ripple components and furthermore attenuates any noise spikes appearing in the circuit. The cathode of the diode reflecting the potential of the collector of transistor 111, is tied to a positive input of an operational amplifier 121 forming the central element of the filter stage 85. The negative input of operational amplifier 121 is connected across a series connection comprising a capacitor 122, resistor 123 and the potentiometer 25 to ground. In addition, there is a feedback around amplifier 121 providing the necessary bandpass. More specifically, shown connected between the output and the negative input of amplifier 121 is a parallel circuit combination comprising a feedback resistor 126 in parallel with a capacitor 127 and a diode 128. The polarity of the diode 128 is output to negative input, thus providing the necessary clamping or the necessary gain drop-off for reductions in signal level at the positive input. Thus, the circuit configuration around amplifier 121 is that of a bandpass filter where the low pass function is determined by the resistance and capacitance values in the feedback and the high pass function is, in turn, determined by the capacitor 122. For the purposes herein it is intended to utilize a value of approximately 150 microfarads for capacitor 122 in series with two K ohm resistance in resistor 123. The feedback resistor 126 is contemplated for the value of one megohm and the capacitor 127 is set at 0.2 microfarads.

This set of circuit elements provides a bandpass function of between 1 cycle to 10 cycles per second, the filter capacitor 118 taking out all of the high frequency ripple. This bandpass filter is then connected across a coupling capacitor 131 to the summing node of a voltage divider comprising a series combination of a resistor 132, a diode 133, yet another resistor 134, and a variable resistor 135. It is contemplated to dispose this voltage divider circuit across the output of switch 20 and ground, the division point being made at the cathode of the diode 133. This same division point is then applied as the input signal to yet another amplifier 141 such as the CA3098 amplifier built by the RCA Corporation. Amplifier 141, in the conventional mode, is a linear amplifier including in the feedback thereof a diode 142, once more providing a clamping function. The other two inputs to amplifier 141 are developed across a resistor 143 disposed between the cathode of diode 142 and yet another resistor 144 tied to ground. Again the cathode of diode 142 is connected to ground across a capacitor 145 and similarly the cathode of diode 133 is tied to ground by yet another capacitor 136. It is these connections that provide both the necessary rate response and the polarity to amplifier 141, thus decoupling the operation of this amplifier from the drift across the capacitor 131. The output of amplifier 141 is tied across a series connection of resistors 146 and 147 to the signal +V appearing at the output of switch 20, the junction between these two resistors providing the base input to a PNP transistor 148 with the emitter thereof tied once more to the signal +V. The collector end of transistor 148 is tied across light emitting diode 151 in series with a resistor 152 to ground and across the foregoing switch 22 to a conventional tone coded transmitter. In the alternative position of switch 22 a beep or a local beep generator 21 is excited while the remote sending capability of transmitter 51 is disabled.

By way of the foregoing connections, a tuned circuit is formed around the oscillator 71 which is decoupled from any electro-magnetic signals present in the air and picked up by the sensing antenna 15. Furthermore, the frequency at which this oscillating circuit resonates can be set at any desired level, and in fact can vary from detector to detector without affecting the performance of the circuit.

Figure 4:
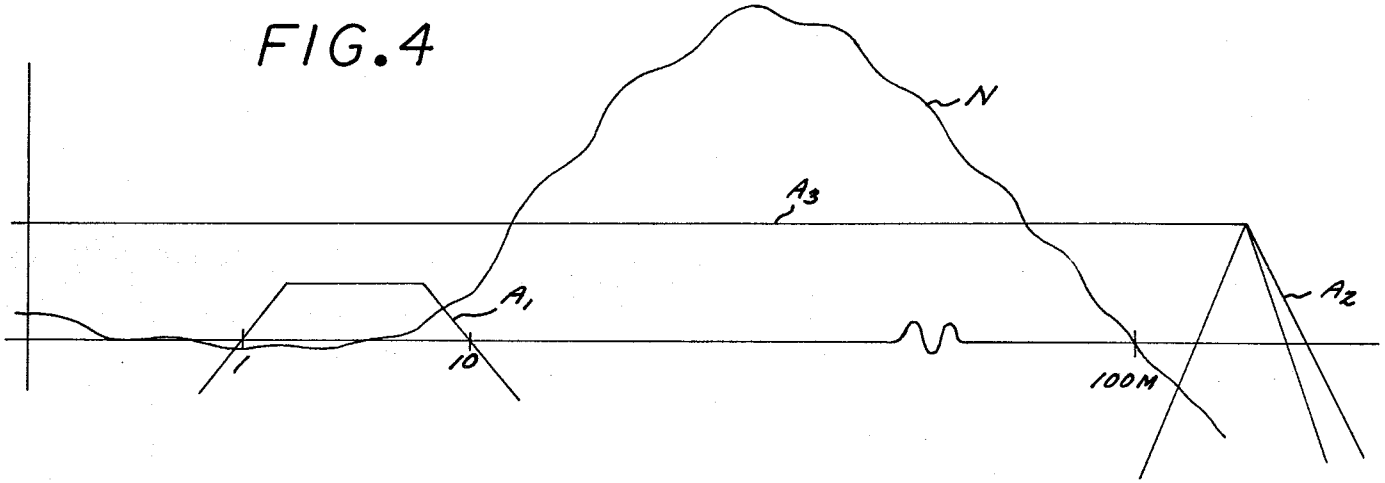
FIG. 4 is a Bode diagram exemplifying the operations set out herein.

By way of FIG. 4 the foregoing advantages are best brought out. More specifically, FIG. 4 illustrates in Bode plot format the various response characteristics provided for herein, where for example the bandpass set out by the curve Al and corresponding to the bandpass provided around amplifier 121 is removed by quite a few decades from the bandpass shown herein as the bandpass A1 which corresponds to the resonance of the tank circuit. The amplitude however is essentially independent of bandpass, being cut off only at the upper limit of A2. For that reason there is shown a third curve A3 having the same high frequency shape as the curve A2 and having a constant amplitude across all lower frequencies. It is this signal A3 that varies in amplitude with the proximate changes occurring when an intruder is present. Furthermore, it is these amplitude changes that are discriminated at 1–10 cycles per second by the bandpass set out in A-1. Thus, any noise spectrum shown herein as an arbitrary spectrum N having normally very low components around 1–10 cycles per second will be grossly attenuated by this circuit.

Obviously many modifications and variations to the above disclosure can be made without departing from the spirit of the invention. It is therefore intended that the scope of the invention be determined solely dependent on the claims hereto.

What is claimed is:

1. A security device adapted to monitor a secured area for the presence of an intruder comprising:

an oscillator including a tank circuit coupled to respond to the capacitive and inductive field changes associated with said intruder, said oscillator further including a constant current device tied to said tank circuit for maintaining the frequency thereof substantially constant and for providing amplitude changes in the output signal of said oscillator in response to said capacitive and inductive field changes associated with said intruder;

bandpass filter means connected to receive said output signal from said oscillator means said bandpass filter means being conformed to produce a filtered signal corresponding to the frequency components of said output signal which are in the frequency domain of the field changes of said intruder;

differentiating means connected to receive said filtered signal for producing a switching signal when the rate of change of said filtered signal exceeds a predetermined level;

transmitting means connected to be rendered operative by said switching signal for producing a radio signal upon the receipt of said switching signal; and receiving means conformed to respond to said radio signal for producing an audio signal indicative thereof.

2. Apparatus according to claim 1 wherein:

said bandpass filter means includes gain adjustment means for manually selecting the amplitude ratio between said output signal and said filtered signal.

3. Apparatus according to claim 2 wherein:

said bandpass filter means is conformed as an active filter set to pass frequencies between 1 to 10 cycles per second.

4. Apparatus according to claim 3 wherein:

said differentiating means includes a coupling capacitor connected to receive said filtered signal at one end thereof and to a voltage divider at the other end thereof and a comparator connected to receive the combination of signals from said coupling capacitor and said divider.

5. A security device adapted to monitor a secured area for the presence of an intruder comprising:

an oscillator including a tank circuit coupled to respond to the capacitive and inductive field changes associated with said intruder, said oscillator providing amplitude changes in the output signal of said oscillator in response to said capacitive and inductive field changes associated with said intruder;

bandpass filter means connected to receive said output signal from said oscillator means said bandpass filter means being conformed to produce a filtered signal corresponding to the frequency components of said output signal which are in the frequency domain of the field changes of said intruder;

differentiating means connected to receive said filtered signal for producing a switching signal when the rate of change of said filtered signal exceeds a predetermined level;

transmitting means connected to be rendered operative by said switching signal for producing a radio signal upon the receipt of said switching signal; and receiving means conformed to respond to said radio signal for producing an audio signal indicative thereof.

* * * * *